United States Patent [19]

Flanagan

[11] 4,426,034

[45] Jan. 17, 1984

[54] TWO PIECE PACKING CASE

[75] Inventor: Thomas L. Flanagan, Killingworth, Conn.

[73] Assignee: Standard-Knapp, Inc., Portland, Conn.

[21] Appl. No.: 408,222

[22] Filed: Aug. 16, 1982

[51] Int. Cl.[3] ..... B65D 13/00; B65D 5/68

[52] U.S. Cl. ..... 229/23 BT; 229/32; 229/43

[58] Field of Search ..... 229/23 R, 23 BT, 43, 229/32

[56] References Cited

U.S. PATENT DOCUMENTS

| | | | |
|---|---|---|---|
| 1,357,519 | 11/1920 | Russell | 229/32 |
| 3,054,682 | 9/1962 | Russell | 229/43 |
| 3,134,499 | 5/1964 | Johnson | 229/23 BT |
| 3,543,994 | 12/1970 | Clark | 229/23 BT |
| 3,810,573 | 5/1974 | Russell | 229/23 BT |

FOREIGN PATENT DOCUMENTS

| | | | |
|---|---|---|---|
| 364566 | 12/1931 | United Kingdom | 229/32 |

*Primary Examiner*—Herbert F. Ross

*Attorney, Agent, or Firm*—McCormick, Paulding & Huber

[57] ABSTRACT

Three packing cases are disclosed each having a tray and a top portion so assembled that abutting marginal edges of the side and end panels of the tray and cover are adapted to support one case stacked upon another without relying upon the columnar strength of the contents of the case, and where the tray and cover individually have a vertical height significantly less than the height of the product contained in the case. The tray and cover are fabricated from a multiple ply corrugated cardboard material and conventionally formed from generally flat rectangulr blanks with uniquely arranged end flaps such that the flaps can be glued to the tray and nevertheless easily disassembled for purposes of displaying the contents of the tray after the cover has been removed.

12 Claims, 11 Drawing Figures

TWO PIECE PACKING CASE

This invention relates generally to packing cases of corrugated paperboard, and deals more particularly with a two piece case which includes a bottom tray portion having an overall height less than the height of the product in order to provide an effective display device for the product at the point of sale. The two piece case also includes a top or cover portion adapted to be so assembled with the tray portion that the product contained in the assembled case is well protected even when several such cases are stacked on top of one another during shipment and storage. These features are especially significant in connection with the storage, shipment and sale of liquid filled aseptic paper containers of the type which are currently being utilized for fruit juices and milk to avoid the need for refrigeration, at least until the individual containers are opened. Another advantage of the two piece case described herein can be attributed to the fact that the top or cover portion can be glued to the lower tray portion and/or the assembled case can be shrink film wrapped and/or taped. Finally, it should also be noted that the packing case constructions described herein permits fabrication of a relatively rigid packing case in which the quantity of paperboard material is minimized for a given size and volume of product contained therein.

Several versions of the invention are disclosed, but each comprises a two piece packing case adapted to contain a product array of generally rectangular aseptic containers. Each container has a height "h", and each container array consist of M rows and N columns of containers to provide a generally rectangular charge or slug of articles in the case of height "h". The case comprises a tray formed from a generally flat rectangular blank having a bottom panel to support the product in the array. Side and end panels are integrally connected to the bottom panel along fold lines arranged in pairs such that the side panels can be folded at right angles to the bottom panel. One of the pairs of such panels defines projecting tray flaps which are adapted to abut the other of said pairs of panels, either internally or externally, when the blank is folded and glued. These side panels have a height which is less than the height "h" of the product and the end panels have a height which is either more than or less than the height of the side panels.

Another part of the packing case comprises a top or cover portion adapted to be received or assembled on the tray in such a way that the side panels and the end panels abut one another edgewise to provide a relatively rigid packing case for the type of product described above. The top portion also comprises an initially flat rectangular blank having pairs of side and end panels integrally connected to opposed fold lines such that they are folded at right angles to the top panel. Top flaps formed on either the side or the end panels and are folded, externally preferably, and glued in much the same manner as that for preparing the tray. These top flaps in the top or cover portion of the packing case preferably include depending portions which can be glued to the tray side or end panels. Further, the top portion has a height, also less than the height of the product, and such that the side and end panel heights match those of the tray in order to provide a combined height "h" equivalent to that of the product array contained therein.

Figure 10:
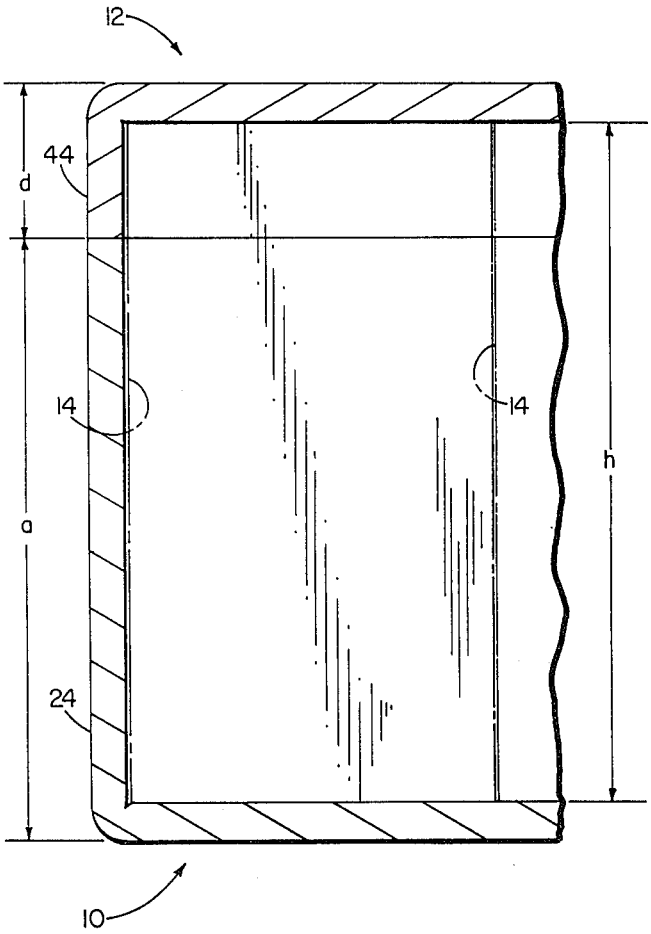
FIG. 10 is a sectional view illustrating the abutting edge portions of the side panels of the two piece case illustrated in FIG. 1.
Figure 11:
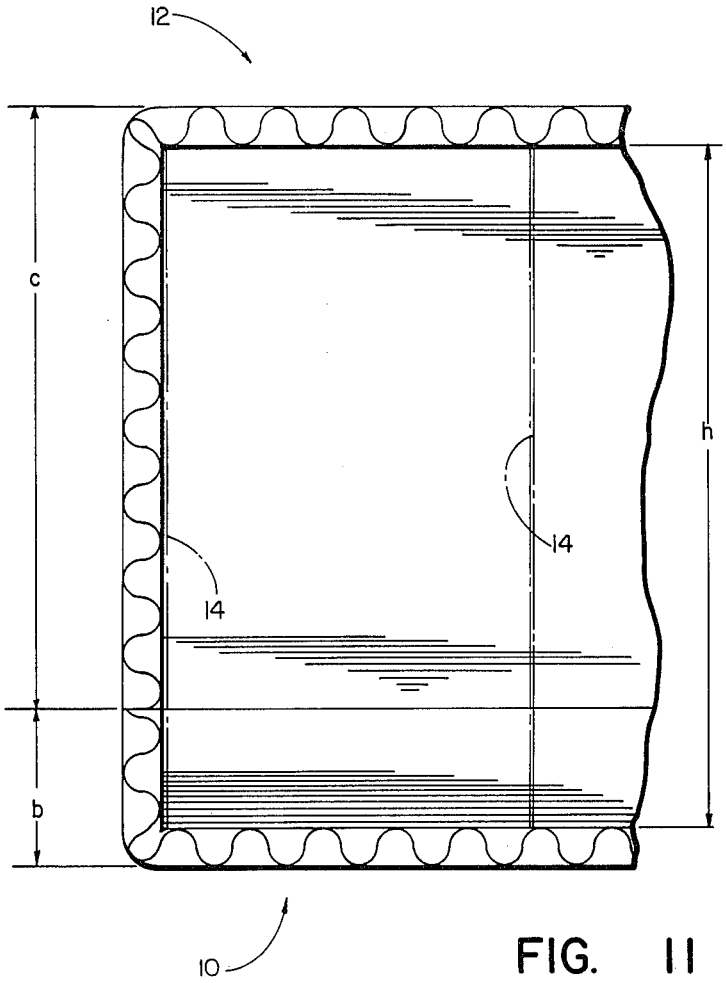
FIG. 11 is a sectional view on the line 11—11 of FIG. 1 illustrating the abutting edge portions of the end panels in the cover and tray portions of the FIG. 1 packing case.

Turning now to the drawings in greater detail, and referring particularly to FIGS. 1, 4, 5, 10 and 11, the first version of the present invention is there illustrated as comprising a packing case having a bottom portion or tray 10 assembled with a top or cover portion 12 to provide a two piece case well adapted to contain generally rectangular aseptic containers such as illustrated at 14, 14 in FIGS. 10 and 11. These containers are fabricated from paper, and hence have very little columnar strength with the result that they cannot be shipped and/or stored in conventional shrink film wrapped tray type packaging of the type currently used in connection with glass bottles, plastic containers, and metal cans. Rather than resorting to a conventional one piece packing case, with the excess paperboard material required for forming the bottom and top flaps, this invention seeks to minimize the quantity of paperboard material required and to nevertheless retain the advantages inherent to utilization of a tray as the lower portion of the case in order to provide a convenient display device for the retailer.

Figure 5:
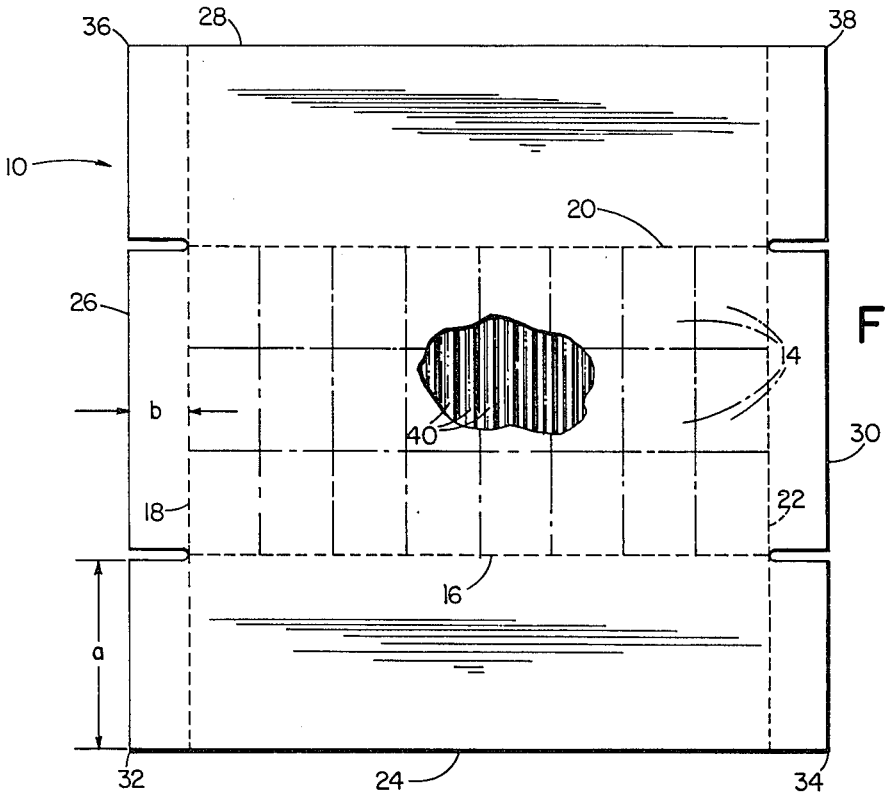
FIG. 5 is a plan view of a rectangular blank from which the tray of FIG. 1 is adapted to be fabricated.

FIG. 5 illustrates the tray blank before folding, and the array of liquid filled containers 14, 14 is shown in phantom lines as comprising, in this illustration, three columns of eight rows providing a twenty-four container array in the case. These containers are arranged on the bottom panel of the tray blank 10, that is within the mutually perpendicular fold lines 16, 18, 20 and 22. These fold lines are arranged in opposed pairs and each fold line serves to integrally connect pairs of panels, of dimensions "a" and "b", to the bottom panel as follows. As shown, side panels 24 and 28 of height "b" are connected to fold lines 16 and 20 whereas end panels 26 and 30 of height "a" are connected to fold lines 18 and 22 respectively.

The tray blank 10 also includes tray flaps 32 and 34 integrally connected to end portions of side panel 24 along fold lines which assure that these flaps 32 and 34 can be folded at right angles to the side panel 24 and be thereby located adjacent end panels 26 and 30 when the side panel is folded along its fold line 16 and end panels 26 and 30 folded on lines 18 and 20. Similarly, tray flaps 36 and 38 are provided at end portions of side panel 28 and are adapted to be similarly folded as suggested in FIG. 1. Finally, it should be noted that the generally flat tray blank of FIG. 5 is fabricated from a corrugated paperboard material with the corrugations 40, 40 in the central ply of the conventional three ply paperboard material oriented perpendicular to the fold line 16 and 20.

Figure 1:
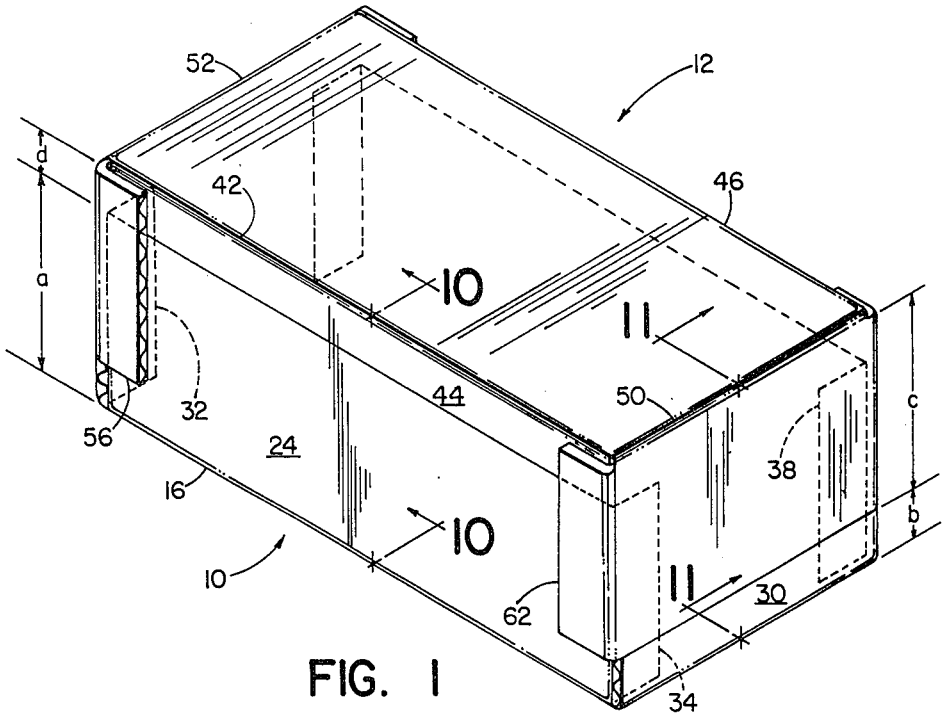
FIG. 1 is a perspective view of a two piece packing case constructed in accordance with the present invention.
Figure 4:
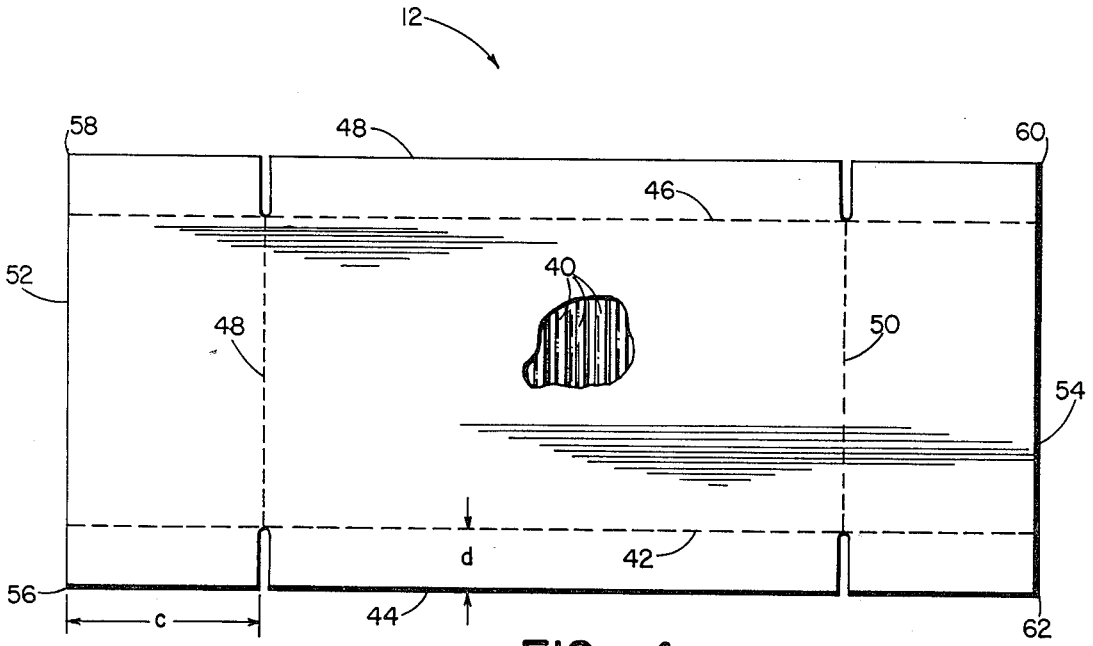
FIG. 4 is a plan view of a generally flat rectangular blank from which the cover or top portion of the packing case in FIG. 1 is fabricated.

The blank 12 of FIG. 4, which forms the cover portion for the packing case of FIG. 1, is also fabricated from a three ply corrugated paperboard material with the corrugations 40, 40 also running perpendicular to the fold lines 42 and 46. The fold lines 42 and 46 are associated with side panels 44 and 48 respectively which side panels have a dimension "d" as indicated in FIG. 4 such that "d" plus the corresponding dimension "a" of the side panels in the tray combine to provide the desired height "h" of the assembled case as described above with reference to FIG. 10. Fold lines 48, 50 associated with end panels 52, 54 respectively have a dimension "c" as indicated in FIG. 4 such that when folded and assembled with the tray portion provide a combined height "c" plus "b" equal to the product height "h" as described above with reference to FIG. 11. This geometry provides a two piece packing case with relatively rigid side and end walls as shown in FIGS. 1, 10 and 11 with the corrugations running perpendicular to the mating edges of the side panels (FIG. 10) in order to maximize the strength of the packing case when stacked in a series of such cases for storage or shipment purposes. Still with reference to the cover 12 of FIG. 4 top flaps 56 and 58 are associated with end portions of end panel 52 and are adapted to be folded externally of the side panels 44 and 48 respectively when the top portion is folded and glued, and is assembled with the similarly formed tray of FIG. 5. End flaps 60 and 62 are provided at end portions of the end panel 54 and it should be noted that these top flaps 56, 58, 60 and 62 include lower regions which engage the side panels 24 and 28 of the tray with the result that the cover 12 can be glued to the tray 10 in this area.

Figure 2:
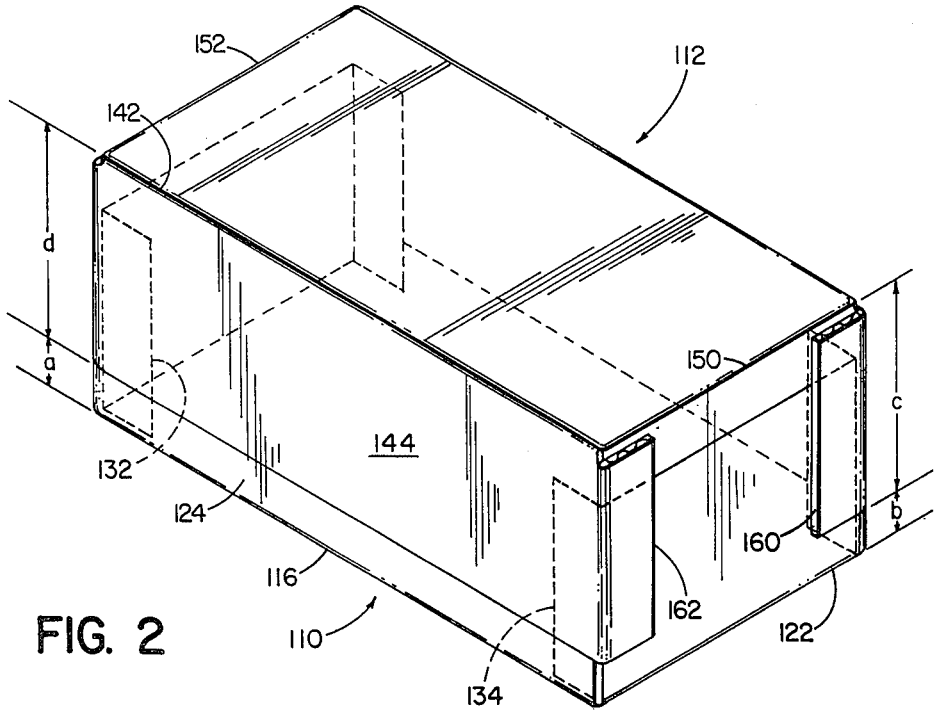
FIG. 2 is a perspective view of a modified version of a two piece packing case constructed in accordance with the present invention.

Turning next to a detailed description of the second version of an improved two piece packing case as illustrated in FIG. 2, such a case includes a tray portion 110 (FIG. 7) which is adapted to be assembled with a cover portion 112 (FIG. 6) to provide a relatively rigid packing case well adapted to protect aseptic paper containers of the type referred to previously, and to display such containers when the cover portion 112 is removed.

Figure 7:
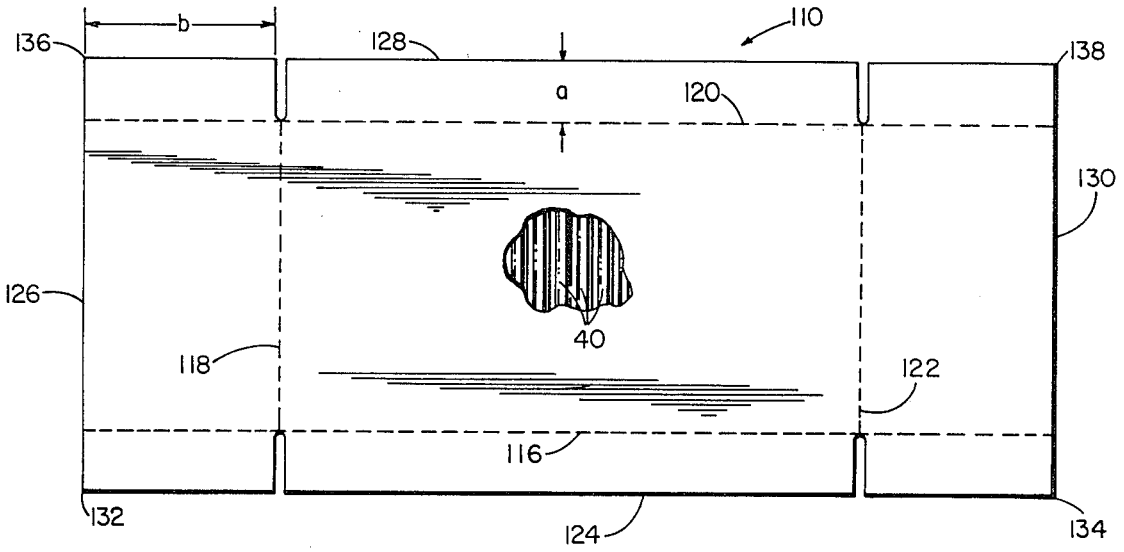
FIG. 7 is a plan view of a rectangular blank from which the tray portion of the two piece case of FIG. 2 is adapted to be fabricated.

The tray 110 is formed from a rectangular blank of corrugated paperboard material as suggested in FIG. 7, and the corrugations 40, 40 preferably run at right angles to the fold lines 116 and 120 associated with the side panels 124 and 128 respectively. Fold lines 118 and 122 cooperate with the fold lines 116 and 120 to define the bottom panel of the tray which bottom panel supports the array of product consisting in M rows and N columns similar to that described above with reference to FIG. 5. End panels 126 and 130 include tray flaps 132, 136 and 134, 138 respectively which tray flaps are adapted to be folded internally as described previously with reference to the tray 10 of FIG. 5 and as shown in FIG. 2.

Figure 6:
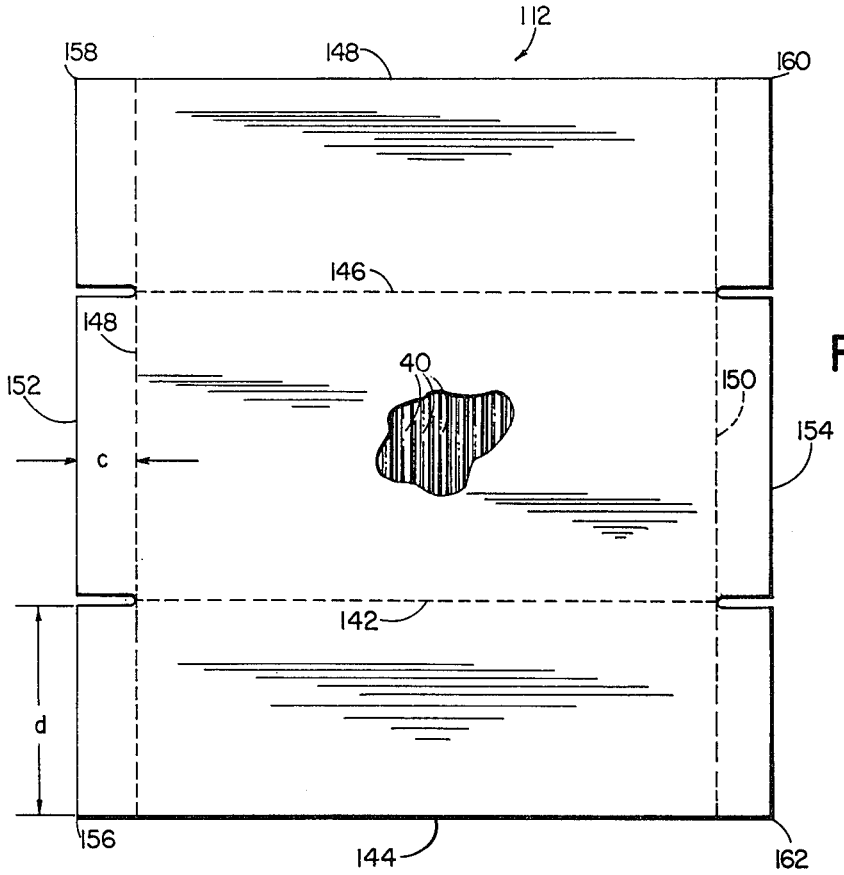
FIG. 6 is a plan view of a rectangular blank from which the cover of the FIG. 2 packing case is adapted to be fabricated.

The cover 112 is illustrated in FIG. 6 in rectangular blank form prior to folding and gluing. Here again the corrugations 40, 40 run perpendicular to the fold lines 142 and 146 of the side panels 144, 148 as was true in the cover 12 of the FIG. 1 embodiment. End panels 152 and 154 are integrally connected to the top panel of the cover 112 by fold lines 148, 150 respectively. Top flaps 156, 158, 160 and 162 are integrally connected to the side panels 144 and 148 along fold lines such that these flaps are externally folded against the exterior of the end panels 152 and 154 as best shown in FIG. 2. As so constructed and arranged the assembled two piece packing case of FIG. 2 provides rigidity for the case in the area of the side walls and the end walls in the same manner as that described above with reference to FIGS. 10 and 11 respectively in connection with the first embodiment.

Figure 3:
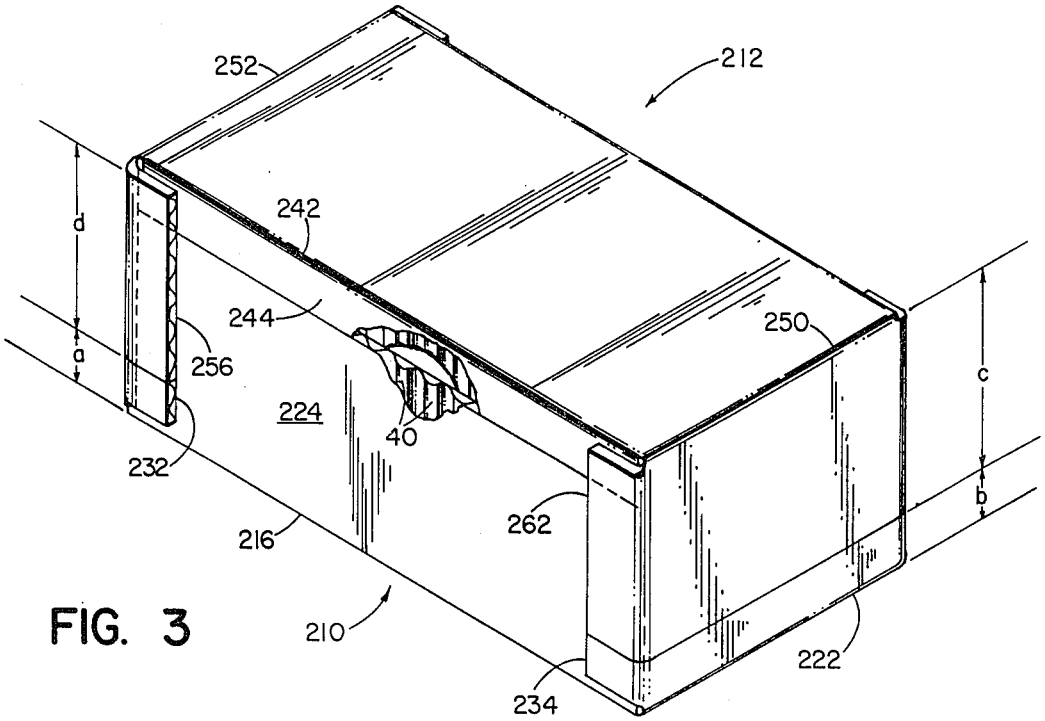
FIG. 3 is a third embodiment of two piece packing case constructed in accordance with the present invention.
Figure 8:
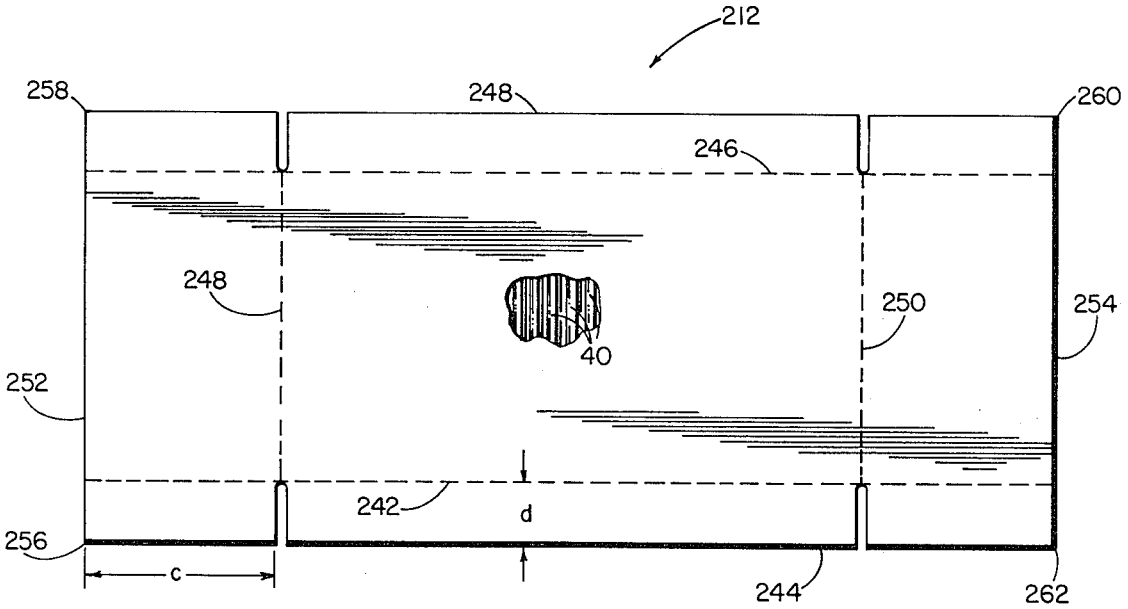
FIG. 8 is a plan view of a rectangular blank from which the cover portion of the FIG. 3 packing case is adapted to be fabricated.
Figure 9:
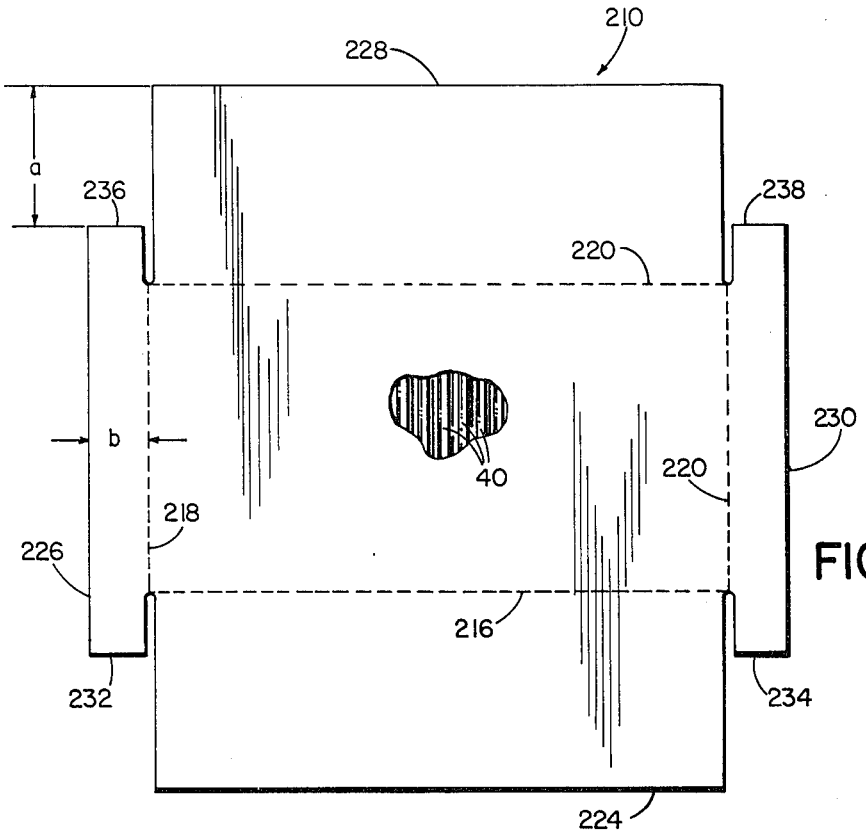
FIG. 9 is a plan view of a generally flat blank from which the tray portion of the FIG. 3 packing case is adapted to be fabricated.

Turning next to a detailed description of the packing case version illustrated in FIG. 3 the tray 210 is assembled with the covers 12 and these corrugated cardboard elements are formed from initially flat generally rectangular blanks as illustrated in FIGS. 9 and 8 respectively. Whereas in the tray versions illustrated in connection with FIGS. 1 and 2 the tray flaps are folded internally, it will be apparent from FIG. 3 that the flaps 232 and 234 are folded externally. This provides a side panel 224 extending the full length of the tray in order to assure that the internal dimensions of the tray are precisely rectangular to receive the array of generally rectangular containers of the type described previously. The corrugations 40, 40 of the center ply of the corrugated cardboard material from which the tray and its cover are fabricated run perpendicular to the fold lines 216, 220 (FIG. 9) and 242, 246 (FIG. 8). The side panels of the cover or top portion are indicated generally at 244 and 248 in FIG. 8 and the end panels 252 and 254 are similarly connected along fold lines 248, 250 respectively. Top flaps 256, 258, 260 and 262 are connected to end portions of the end panels and are themselves folded externally of the side panels for the top as described previously with reference to the FIG. 1 version. As so constructed and arranged lower regions of these flaps (best shown in FIG. 3) are adapted to be glued to the underlying regions of the side panels 224, 228 of the tray 210.

I claim:

1. A packing case for a product array of height "h" having M rows of N columns, said case comprising a tray formed from a flat blank which has a bottom panel to support the product in said array, and said tray blank having pairs of side and end panels integrally connected along fold lines at right angles to said bottom panel, one of said pairs of panels having tray flaps adapted to abut the other of said pairs of panels when said blank is folded and glued, said side panels having a height "a" less than the height "h" of the product and said end panels having a height "b", and said case including a top portion received on said tray, said top portion also formed from a flat blank and having a top panel adapted to cover the product in said array, and said top portion blank having pairs of side and end panels integrally connected along fold lines at right angles to said top panel, one of said pairs of panels of said top portion having top flaps adapted to abut the other of said pair of panels when said blank is folded and glued, said end panels of said top portion having a height "c" less than the height "h" of the product so that the lower marginal edges of said top portion end panels abut the upper marginal edges of said tray end panels, said side panels of said top portion having a height "d" such that the lower marginal edges thereof abut the upper marginal edges of said tray side panels, and the combined heights of said end panels ("b"+"c") being approximately equal to the product height "h" and to the combined heights ("a"+"d") of said side panels.

2. The packing case of claim 1 wherein "a" is not equal to "b" and wherein the tray flaps are provided on the pair of tray panels having the greater height dimension.

3. The packing case of claim 1 wherein "c" is not equal to "d" and wherein the top flaps are provided on the pair of top portion panels having the greater height dimension.

4. The packing case of claim 1 wherein said tray blank and said top portion blank are made from a multiple ply paperboard material.

5. The packing case of claim 4 wherein said paperboard material has at least one inner ply of corrugated paperboard so oriented that the corrugations run at right angles to one pair or fold lines in said tray and in said top portion.

6. The packing case of claim 5 wherein said tray side panels have a longitudinal dimension "l" and said end panels a dimension "w" which is less than "l", and said corrugations oriented at right angles to said tray side panel fold lines.

7. The packing case of claim 5 wherein said height "c" of said top portion end panels is greater than said height "d" of said top portion side panels, and wherein the top flaps are provided on said end panels and are folded externally of said top portion side panels so that lower regions of said top flaps engage said tray side panels.

8. The packing case of claim 5 wherein said height "d" of said top portion side panels is greater than said height "c" of said top portion end panels, and wherein the top flaps are provided on said side panels and are folded externally of said top portion end panels so that lower portions of said top flaps engage said tray end panels.

9. The packing case of claim 7 wherein said height "a" of said tray side panels is greater than said height "b" of said tray end panels, and wherein said tray flaps are provided on said side panels and are folded internally of said tray end panels.

10. The packing case of claim 7 wherein said height "a" of said tray side panels is greater than said height "b" of said tray end panels, and wherein said tray flaps are provided on said end panels and are folded externally of said tray side panels.

11. The packing case of claim 5 wherein said height "c" of said top portion end panels is less than said height "d" of said top portion side panels, and wherein the top flaps are provided on said side panels and are folded externally of said top portion end panels so that lower regions of said top flaps engage said tray end panels.

12. The packing case of claim 11 wherein said height "a" of said tray side panel is less than said height "b" of said tray end panels, and wherein said tray flaps are provided on said end flaps and are folded internally of said tray side panels.

* * * * *